United States Patent [19]

Reznik

[11] Patent Number: 4,739,140

[45] Date of Patent: Apr. 19, 1988

[54] APPARATUS AND METHOD FOR ELECTRICAL HEATING OF FOOD PRODUCTS

[76] Inventor: David Reznik, 2151 Barbara Dr., Palo Alto, Calif. 94303

[21] Appl. No.: 733,750

[22] Filed: May 14, 1985

[51] Int. Cl.[4] ..... H05B 6/54

[52] U.S. Cl. ..... 219/10.81; 219/10.75; 426/244; 99/DIG. 14; 99/358

[58] Field of Search ..... 219/10.81, 10.75, 10.57; 426/241, 243, 234, 244–247; 99/DIG. 14, 451, 358

[56] References Cited

U.S. PATENT DOCUMENTS

| | | | |
|---|---|---|---|
| 2,212,794 | 8/1940 | Salinski | 99/358 X |
| 2,469,709 | 5/1949 | Ashworth et al. | 219/10.81 |
| 2,838,640 | 6/1958 | Mann et al. | 219/10.81 X |
| 2,945,935 | 7/1960 | Messner et al. | 426/234 X |
| 3,082,710 | 3/1963 | Holland | 219/10.81 X |
| 4,091,119 | 5/1978 | Bach | 219/234 |
| 4,496,594 | 1/1985 | Miyahara | 99/358 |

FOREIGN PATENT DOCUMENTS

| | | | |
|---|---|---|---|
| 904371 | 8/1962 | United Kingdom | 99/358 |

*Primary Examiner*—Philip H. Leung
*Attorney, Agent, or Firm*—Regan J. Fay

[57] ABSTRACT

Apparatus and a method for food processing wherein an AC electrical current at a frequency exceeding mains frequencies is caused to pass through a food product producing direct resistance heating of the food product, the frequency being selected to preclude substantial electrolysis of the food product.

9 Claims, 3 Drawing Sheets

APPARATUS AND METHOD FOR ELECTRICAL HEATING OF FOOD PRODUCTS

FIELD OF THE INVENTION

The present invention relates to apparatus and techniques for food processing generally and more particularly to food processing involving electrical heating.

BACKGROUND OF THE INVENTION

There exist many techniques for heating food products electrically, employing alternating current. U.S. Pat. No. 4,417,132 describes an example of such a technique applied to liquid foodstuffs. U.S. Pat. No. 3,996,385 discloses alternating current electrical heating of potatoes immersed in an electrolyte solution, wherein the current level is varied along the processing path. U.S. Pat. No. 3,632,962 illustrates the application of alternating current to meat and similar food for heating thereof by direct contact with electrodes.

U.S. Pat. No. 3,651,753 describes a control circuit for alternating current cooking appratus which compensates automatically for changes in load resistance and/or supply voltage.

All of the above patents indicate the use of alternating current at mains frequencies, i.e. 60 Hz or below. It has been found by applicant that the use of mains frequencies is unsuitable for food processing due to the resulting electrolysis and damage to the structure of the food products. The electrolysis may cause chemical contamination of food products through oxidation and/or reduction. For example, ordinary cooking salt may be broken down into hydrogen, chlorine and sodium hydroxide. An additional difficulty with the prior art apparatus is the tendency of the electrodes to dissolve, possibly resulting in contamination of the food products.

It has been found by applicant that application of AC current at mains frequencies also causes substantial breakdown of the cellular structure of the food products, which is often undesireable.

Although the use of high frequency radiation is well known in microwave cooking applications, the use of such high frequencies has not been taught or suggested in the prior art for electroheating applications wherein AC current is caused to pass through a food product.

Induction heating of food products is also well known in the art and is described in the following U.S. Pat. Nos. 4,265,922, 4,241,250 and 3,498,209. In all of these patents, eddy currents are induced in a metal housing or enclosure which is heated and the heat is transferred to the food by conduction.

SUMMARY OF THE INVENTION

The present invention seeks to provide apparatus and techniques for food processing which overcome the above-described limitations and disadvantages of the prior art.

There is thus provided in accordance with a preferred embodiment of the present invention apparatus for food processing comprising means for causing AC electrical current at a frequency exceeding mains frequencies to pass through a food product producing direct resistance heating of the food product, the frequency being selected to preclude substantial electrolysis of the food product.

Additionally in accordance with one preferred embodiment of the invention, the means for causing the AC current to flow comprises a plurality of electrodes disposed in electrical communication with the food product.

Alternatively in accordance with another preferred embodiment of the present invention, the means for causing the AC current to flow comprises means for inducing eddy currents directly in the food product.

In the latter embodiment, the food product to be treated is normally disposed in or caused to pass through a non conductive enclosure surrounded by the induction coil which produces the eddy currents.

The food product to be processed may be either a liquid of any of a wide range of viscosities, for example, extending from fruit juices to tomato paste, or a solid, such as a potato or tomato. Where the food product is a solid, it is immersed in a solution of a conductive liquid such as water.

Additionally in accordance with an embodiment of the present invention, the relative conductivities of the solid food product and the liquid in which it is immersed may be selected to determine the relative speed of heating of the food product. Where only surface heating of the food product is desired, as in techniques for peeling tomatoes, for example, a liquid whose conductivitiy significantly exceeds that of the solid is employed.

Where fast and uniform heating of the solid is desired, its conductivity may be increased so as to exceed the conductivity of the liquid in which it is immersed. This may be accomplished in accordance with the present invention by vacuum impregnation of the solid with a conductive solution. In this way corn cobs or potatoes may be impregnated with a saline solution in order to increase their conductivity and enhance the speed and uniformity of heating thereof.

It is a particular feature of the present invention that by suitable selection of the frequency of the electrical current caused to pass through the food product, it is possible to control the softening of the food product due to by breakdown of the cellular structure thereof. It is appreciated according to the present invention that a relatively lower frequency produces increased structural breakdown while a higher frequency produces less structural breakdown.

There is also provided in accordance with a preferred embodiment of the present invention a method for food processing comprising the step of causing AC electrical current at a frequency exceeding mains frequencies to pass through a food product producing direct resistance heating of the food product, the frequency being selected to preclude substantial electrolysis of the food product.

Additionally in accordance with one preferred embodiment of the invention, the step of causing the AC current to flow comprises the steps of inserting a plurality of electrodes in electrical communication with the food product and applying the AC voltage across the electrodes.

Alternatively in accordance with another preferred embodiment of the present invention, the step of causing the AC current to flow comprises inducing eddy currents directly in the food product.

In the latter embodiment, the food product to be treated is normally disposed in or caused to pass through a non conductive enclosure surrounded by the induction coil which produces the eddy currents.

Additionally in accordance with an embodiment of the present invention, there is provided a method of removing the peel from food products such as tomatoes comprising the steps of disposing the food products to be peeled in a liquid whose conductivitiy significantly exceeds that of the food products, and passing the AC current as described above through the liquid and food products.

Further in accordance with an embodiment of the present invention, the method of treatment of food products may also include the step of impregnation of the food product prior to the passagae of AC electrical current therethrough, whereby the conductivity of the food product is modified thereby. According to a preferred embodiment of the invention, a relatively highly conductive solution is vacuum impregnated into the food product in order to increase its conductivity.

Additionally in accordance with a preferred embodiment of the present invention there is provided a technique for selectable softening of food products comprising the step of passing therethrough an AC electrical current of a frequency exceeding the mains frequency, which frequency is selected to provide a desired degree of breakdown of the cellular structure of the food product.

According to an embodiment of the invention, the frequencies employed in the invention lie in a range above 100 Hz and preferably these frequencies lie in the KHz range. These frequencies may reach as high as 200 KHz, although they need not necessarily be so high.

Additionally according to a preferred embodiment of the invention, the impregnation step and the heating step may be carried out simultaneously. A particularly suitable structure for carrying out these steps may be a barometric leg formed of a non-conductive material, filled with the impregnating liquid and surrounded by an induction coil.

It is a particular feature of the present invention that a high quality, extremely uniformly cooked food product is provided, independently of the size of the food product. The food product may be heated according to the present invention even after it has been packaged, as in a hermetically sealed plastic container.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1:
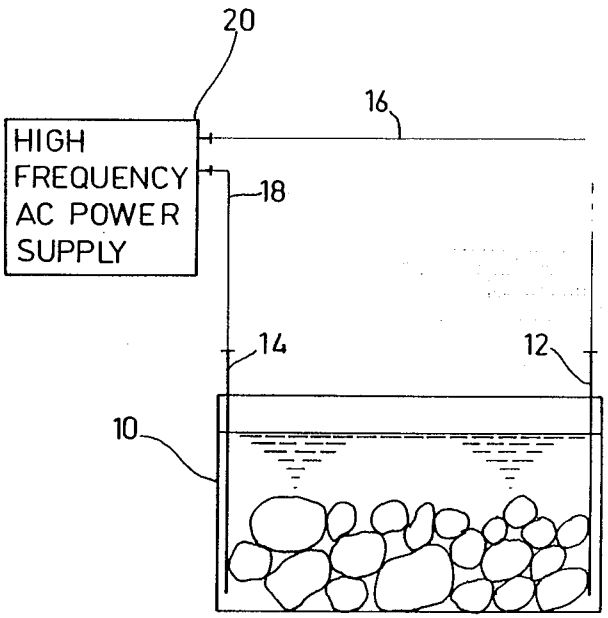
FIG. 1 is an illustration of appratus for food processing constructed and operative in accordance with a preferred embodiment of the present invention.

Reference is now made to FIG. 1, which illustrates apparatus for electrical heating of food products constructed and operative in accordance with a preferred embodiment of the invention and comprising a container 10, typically formed of a non-conductive material, such as plastic, in which a food product to be heated is disposed. The food product may be a liquid of desired viscosity including a paste or a solid. If it is a solid, it is preferably immersed in a conductive liquid, such as water, or a conductive paste.

First and second electrodes 12 and 14 are disposed adjacent opposite sides of the container and are disposed and arranged such that the volume subtended thereby includes all or most of the inside volume of the container.

The first and second electrodes are coupled by means of suitable conductors 16 and 18 to first and second terminals of a high frequency AC power supply 20, typically operating at a selected frequency in the range of 100 Hz to 200 KHz, but preferably at a frequency in the KHz range, such as 1-10 KHz. Power supplies across the entire frequency range of 100 Hz to 200 KHz are commercially available from Westinghouse, Inc. of Pittsburgh, Pa., U.S.A.

EXAMPLE I

Whole, uncooked potatoes of non-uniform size and weight were immersed in water in container 10. A voltage of 440 volts at a frequency of 220 KHz was applied across the electrodes 12 and 14 for a duration of approximately 4 minutes, thereby cooking the potatoes fully. No degradation of the electrodes or electrolysis was encountered. The cellular structure of the potatoes appeared intact.

EXAMPLE II

Tomato paste of uniform conductivity about 35 mmho was placed in container 10. A voltage of 440 volts at a frequency of 220 KHz was applied across the electrodes 12 and 14 for a duration of approximately 2 minutes, thereby cooking the paste. No degradation of the electrodes or electrolysis was encountered.

EXAMPLE III

A whole tomato was immersed in dilute sodium hydroxide and placed in container 10. A voltage of 440 volts at a frequency of 220 KHz was applied across the electrodes for a duration of about 15 seconds. The tomato was not cooked, but its outer skin was heated so as to be separated from the flesh of the tomato.

Figure 2B:
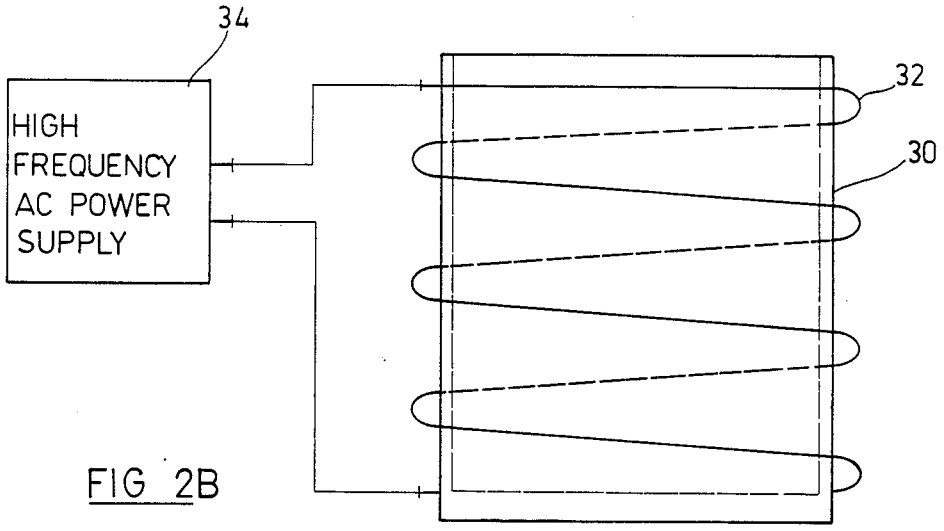
FIGS. 2A and 2B are respective end and side sectional illustrations of apparatus for food processing constructed and operative in accordance with an alternative embodiment of the present invention.
Figure 2A:
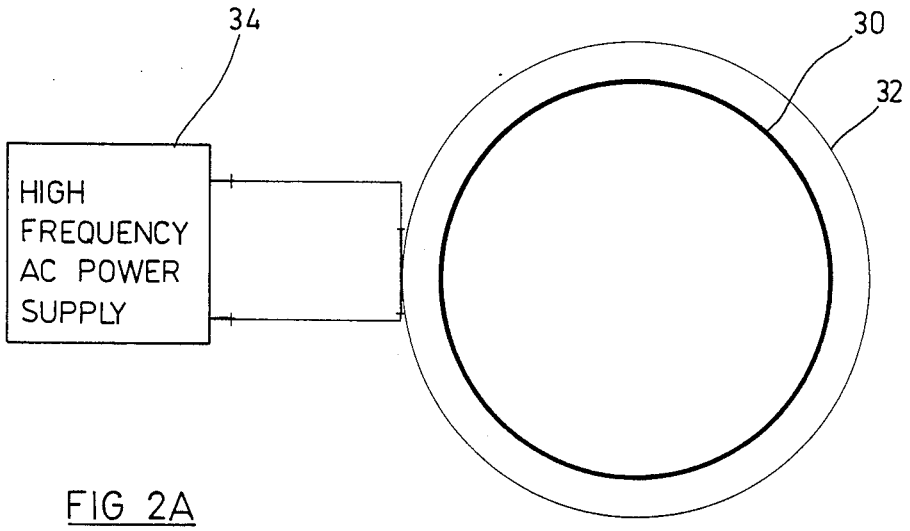

Reference is now made to FIGS. 2A and 2B which illustrate apparatus for induction heating of food products construction and operative in accordance with a preferred embodiment of the invention. The apparatus employs a non-conductive enclosure 30, typically a tube, through which food products pass as they are heated. An induction coil 32 of suitable diameter is wound around enclosure 30 and may be a hollow coil to permit the passage of cooling liquid therethrough. The ends of the induction coil 32 are connected to the terminals of a high frequency power supply 34, which may be identical to power supply 20, of the embodiment of FIG. 1.

It is appreciated that the high frequency power supplies employed in the present invention may have fixed or variable output frequencies. A variable frequency power supply may be preferably so as to permit control of the physical breakdown of the cellular structure of the food product as a function of frequency, it having been determined by applicant that the lower the frequency applied, the greater is the amount of breakdown of the cellular structure. This understanding may be put to practical use in the design of apparatus in accordance with the present invention which products not only heating of the food product but pureeing thereof to a desireable degree.

EXAMPLE IV

Whole, uncooked potatoes of non-uniform size and weight were immersed in water and caused to pass through non-conductive enclosure 30. An AC voltage of 440 volts at a frequency of 220 KHz was applied across the induction coil 32, thereby producing inductive heating of the potatoes for a dwell time of approximately 4 minutes, thereby cooking the potatoes, fully. No electrolysis was encountered. The cellular structure of the potatoes appeared intact. The enclosure 30 was not heated.

EXAMPLE V

Whole, uncooked potatoes of non-uniform size and weight and caused to pass through non-conductive enclosure 30. An AC voltage of 440 volts at a frequency of 450 KHz was applied across the induction coil 32, thereby producing inductive heating of the potatoes for a dwell time of approximately 4 minutes, thereby cooking the potatoes fully. No electrolysis was encountered. The cellular structure of the potatoes appeared intact. The enclosure 30 was not heated.

EXAMPLE VI

Six pounds of tomato paste of uniform conductivity of about 35 mmho was located in enclosure 30. A voltage of 440 volts at a frequency of 450 KHz was applied across the induction coil 32 for a dwell time of approximately 2 minutes, thereby cooking the paste. No electrolysis was encountered. The enclosure 30 was not heated.

EXAMPLE VII

A whole tomato was immersed in water and placed in enclosure 30. A voltage of 440 volts at a frequency of 450 KHz was applied across the induction coil. The tomato was not cooked, but its outer skin was heated so as to be separated from the flesh of the tomato.

Figure 3:
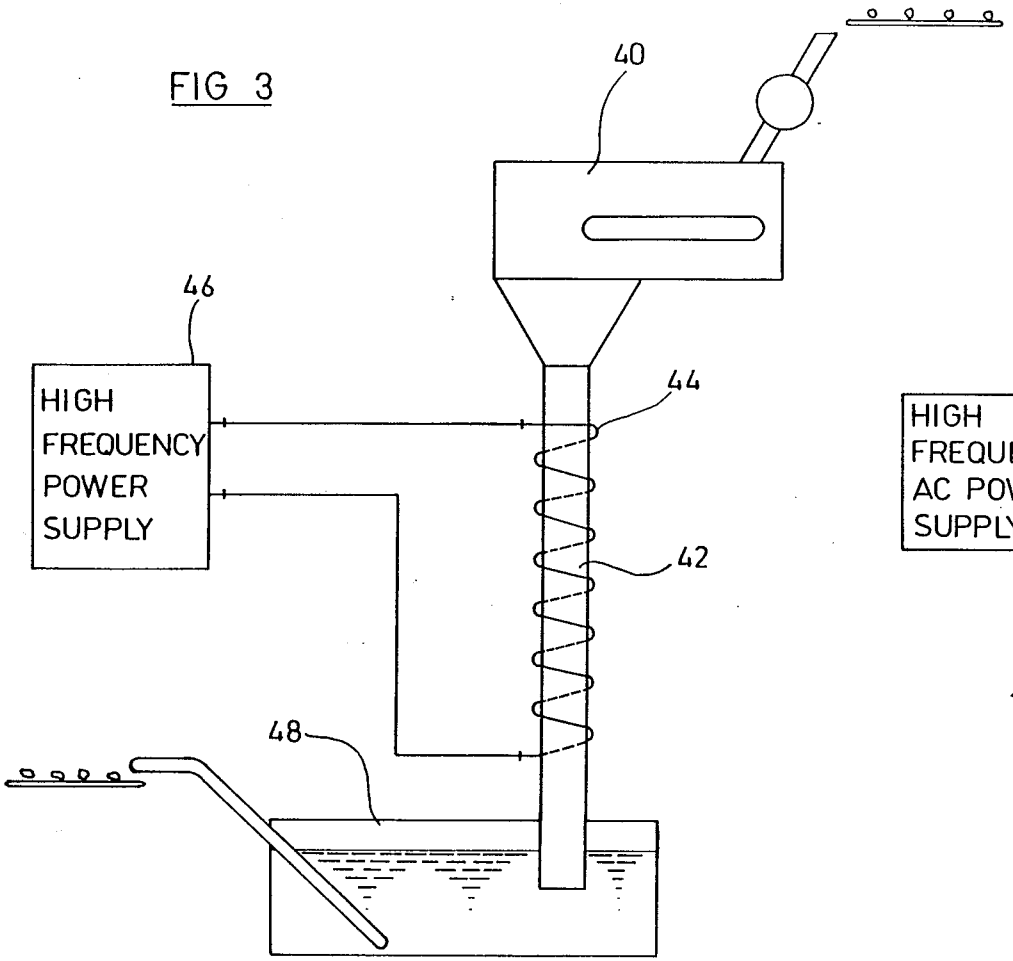
FIG. 3 is an illustration of apparatus for food processing including vacuum impregnation apparatus constructed and operative in accordance with a further alternative embodiment of the present invention.

Reference is now made to FIG. 3 which illustrates an alternative embodiment of the invention employing vacuum impregnation of food products. The vacuum impregnation may be employed to impregnate the food product with a relatively highly conductive liquid, such as a saline solution, thereby to increase its conductivity and enhance speed and uniformity of heating thereof in accordance with the present invention. The apparatus of FIG. 3 includes a vacuum chamber 40 which receives a supply of food products, such as potatoes. A particularly useful vacuum chamber inlet construction is described in U.S. patent application Ser. No. 686,404 filed Dec. 26, 1984, of the present applicant. In the vacuum chamber 40, air is removed from the food product.

The food product is permitted to move from the vacuum chamber into a barometric leg 42 typically defined by a non-conductive vertically disposed tube, filled with a highly conductive liquid, such as a saline solution. As the food product falls through the barometric leg it is impregnated with the conductive liquid.

An induction coil 44 is wound around the barometric leg at a suitable location therealong and is coupled to a high frequency power supply 46 of the same type as that employed in the embodiments of FIGS. 1, 2A and 2B. Operation of the induction coil 44 at a suitable high frequency and voltage as described hereinabove provides heating of the food product as it passes though the barometric leg. The speed and uniformity of heating is enhanced by the impregnation of the conductive liquid therein.

The cooked food product is removed via a bath 48 of conductive liquid at the bottom of the barometric leg 42.

Figure 4:
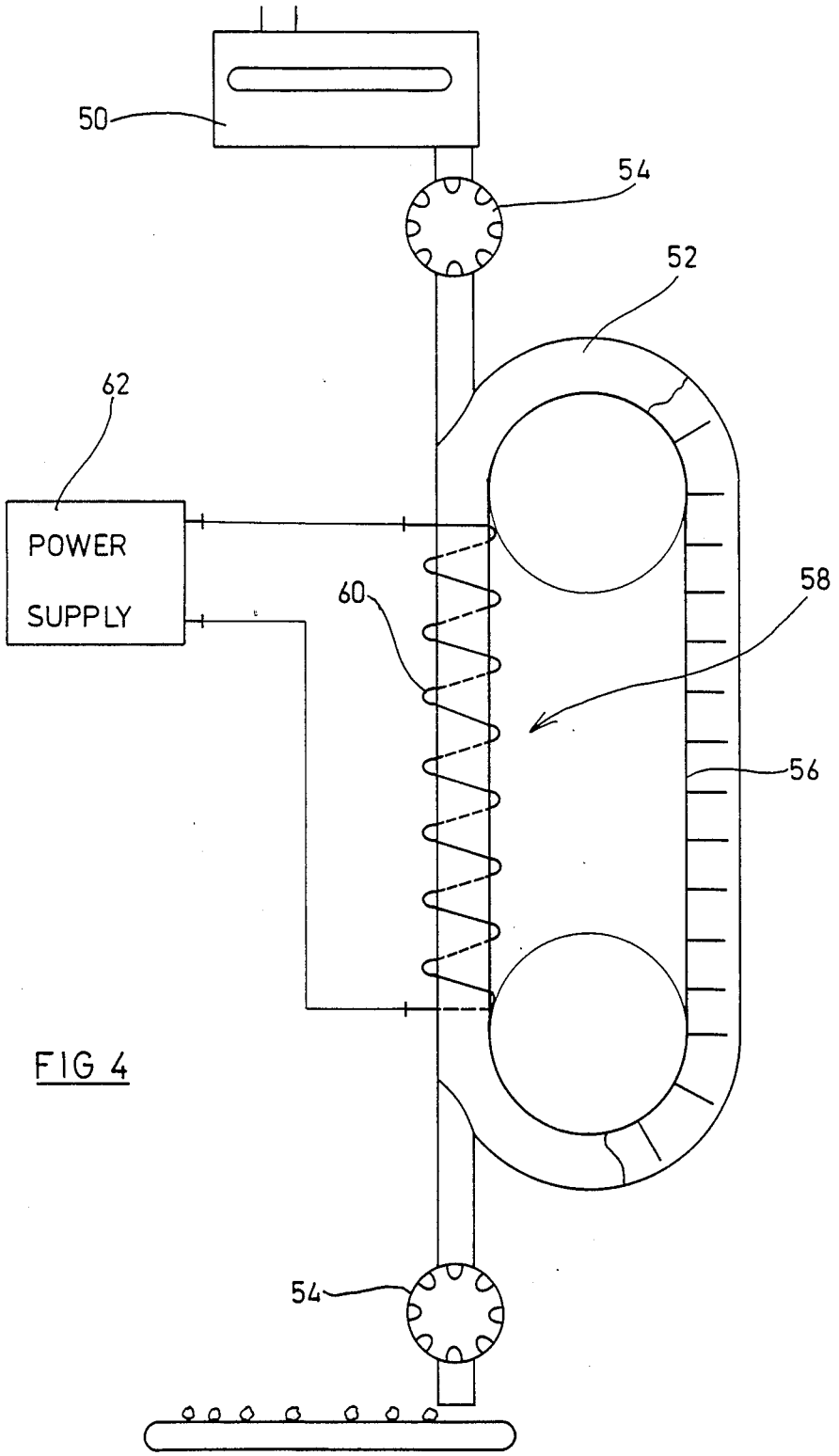
FIG. 4 is an illustration of apparatus for food processing including vacuum impregnation apparatus constructed and operative in accordance with an additional alternative embodiment of the present invention.

FIG. 4 illustrates an alternative embodiment of the invention wherein the impregnation step precedes the heating step. Here food products are first impregnated in a suitable impregnating device 50 and then passed to a vacuum heating device 52 including entrance and exit wheels 54 of a type described in applicant's U.S. patent application Ser. No. 686,404 filed Dec. 26, 1984.

The vacuum heating device includes an endless conveyor 56 which causes the food product to pass an induction region 58 which is surrounded by an induction coil 60 which is in turn coupled to a high frequency power supply 62 of the type employed in the embodiments of FIGS. 1–3. Operation of the induction coil at frequencies and voltages in the general range described hereinabove provides desired heating of the food product.

It will be appreciated by persons skilled in the art that the present invention is not limited to what has been particularly shown and described hereinabove. Rather the scope of the present invention is defined only by the claims which follow:

What is claimed is:

1. Apparatus for food processing comprising:

at least first and second electrodes disposed across a food product and in electrical conducting contact therewith; and means for applying AC electrical current at a frequency exceeding mains frequencies to said electrodes and causing it to pass across said electrodes through said food product, thus producing direct resistance heating of the food product, the frequency being selected to preclude substantial electrolysis of the food product and lying in a range between approximately 100 Hz and 450 KHz.

2. Apparatus according to claim 1 and wherein said food product to be processed is a liquid having a viscosity selected from a wide range of viscosities.

3. Apparatus according to claim 1 and wherein said food product to be processed is a solid.

4. Apparatus according to claim 3 and wherein said food product is immersed in a solution of a conductive liquid such as water.

5. Apparatus according to claim 4 and wherein said produce is immersed in a solution of a conductive liquid having lower conductivity than the food product for providing uniform heating of the solid.

6. Apparatus according to claim 1 and wherein said food product is immersed in a solution of a conductive liquid having higher conductivity than the food product.

7. Apparatus for food processing according to claim 1 and wherein the frequency is selected to provide a desired degree of breakdown of the cellular structure thereof, the amount of cellular breakdown being an inverse function of the frequency.

8. Apparatus according to claim 1 and wherein said frequency lies in a range between approximately 100 Hz and 20 KHz.

9. Apparatus according to claim 8 and wherein said frequency lies in a range between approximately 1 KHz and 10 KHz.

* * * * *